US007325620B2

(12) United States Patent
Carro

(10) Patent No.: US 7,325,620 B2
(45) Date of Patent: Feb. 5, 2008

(54) RECOVERABLE, REINFORCED AND VIBRATION-DAMPING PLUG USED FOR CASED WELLS

(76) Inventor: Gustavo Ignacio Carro, San Martin 325, 5 piso "B", Cipolletti, Rio Negro (AR)

( * ) Notice: Subject to any disclaimer, the term of this patent is extended or adjusted under 35 U.S.C. 154(b) by 274 days.

(21) Appl. No.: 11/006,929

(22) Filed: Dec. 8, 2004

(65) Prior Publication Data

US 2005/0263295 A1 Dec. 1, 2005

(30) Foreign Application Priority Data

May 28, 2004 (AR) ..... P040101861

(51) Int. Cl.
*E21B 33/12* (2006.01)
*E21B 43/11* (2006.01)

(52) U.S. Cl. ..... 166/387; 166/192; 166/181; 175/4.52

(58) Field of Classification Search ..... 166/386, 166/387, 192, 118, 138, 123, 124, 125, 181, 166/55, 55.1, 297; 175/4.54, 4.52, 293
See application file for complete search history.

(56) References Cited

U.S. PATENT DOCUMENTS 3,125,162 A * 3/1964 Briggs, Jr. et al. ..... 166/123
4,576,236 A * 3/1986 Stout et al. ..... 166/386
4,583,592 A * 4/1986 Gazda et al. ..... 166/250.07
4,667,735 A * 5/1987 Salerni et al. ..... 166/55.1
6,152,233 A * 11/2000 Jani et al. ..... 166/382

* cited by examiner

*Primary Examiner*—Kenneth Thompson
(74) *Attorney, Agent, or Firm*—Gottlieb, Rackman & Reisman, P.C.

(57) ABSTRACT

This invention refers to a recoverable, reinforced and vibration-damping plug for cased wells, said wells being for oil, water, gas or any other similar fluid; said plug may be used for conventional casing perforation, high penetration casing perforation and casing perforation using the tubing conveyed perforation system, comprising a pressure equalizing valve having an automatic drilling jar mounted over a holding body with sealing rings interleaved on the perimeter. The plug also comprises a safety latch for said valve, packing means and two sets of opposite, single clamps having a wall that anchor said plug to the casing, which provides an almost complete interlocking. Besides, it is furnished with vibration-damping means that may be rubber rings arranged in such a pattern that they may absorb the energy of the shots produced by the casing perforation, and so to avoid ruptures in the plug members. The plug comprises, also, a threaded mandrel, which thread is reinforced to endure stress and is tooth-shaped to allow shifting in a direction without turning the threaded members and to prevent shifting in the inverse direction.

10 Claims, 1 Drawing Sheet

FIGURE 1

RECOVERABLE, REINFORCED AND VIBRATION-DAMPING PLUG USED FOR CASED WELLS

BACKGROUND OF THE INVENTION

1. Field of the Invention

This invention relates to a recoverable, reinforced and vibration-damping plug used for cased wells, which shall be herein referred to as TPR3, which is part of the tooling used in cased wells, such as oil, water and gas wells. Said plug may be used when it is necessary to temporarily or permanently insulate some areas of the well, allowing multiple operations to be performed, specially those related to large scale perforation where explosive-based methods are used. Examples of said methods are high penetration casing perforation, casing perforation using the tubing conveyed perforation system and conventional casing perforation, these being blasting methods that require large quantities of explosive energy which is released in short periods of time. So, the tools necessary to work with said methods must satisfy rigorous mechanical and thermal requirements. The recoverable, reinforced and vibration-damping plug herein described turns out to be an ideal tool to be used with the abovementioned methods due to its mechanical strength, to the special system provided to be fastened to the casing by means of clamps and to the internal energy absorption devices (vibration dampeners).

For high penetration casing perforation, highly powerful explosives are used, so at the moment of trip there is a high, violent pressure increase till said pressure is dispersed in the well through the fluid therein contained at that moment. The pressure reaches a level which is directly proportional to the shots/foot ratio and to the charge power of the explosives used.

In case of drillings using the casing perforation with the tubing conveyed perforation system the purpose is that the gap between the packer and the recoverable plug be as small as possible and that it be tightly joint so as to rise the pressure inside the casing, so that when being drilled, the accumulated energy may enter as much as possible into the pay zone in order to optimize the drainage channel towards the well, thus optimizing the output. Bearing in mind that in the casing perforation with the tubing conveyed perforation system, the explosive discharges between the plug (fixed at a lower portion of the casing to the discharge area) and the packer (fixed at an upper portion of the casing to the discharge area), and due to the confinements of the space between each punching or due to the design of the discharge chamber where the explosive charge is housed, it is relatively small, so at the moment of the explosion a pressure reaching very high levels, even up to 70000 bars, is generated thus creating extreme strength upon the packer (upstream the chamber) and upon the recoverable plug (downstream the chamber). When the casing is drilled, a by-pass below the packer is open and pressure suddenly drops due to the release of the generated pressure.

In such a situation, the "packer", being a laid tool having an opposing strength defined by the weight of the casing is not shifted from its original position even when it undergoes a heavy jerk. However, the recoverable plug is suddenly pushed downwards and upwards (due to the sudden increase and decrease in pressure), in a short space of time. The shots received are quite sudden and, in general, it shifts within the casing, since the clamps are broken by the explosive strength, thus losing tightness of the packers, while at the same time several permanent damages are caused to the mechanism, in general ruptures and cracks on its metal members. In some instances, even the casing gets damaged. Of Course, such circumstances leave the plug out of service, and so it must be removed from the well ahead of time to be further replaced, without reaching in full the purpose anticipated.

It is for that reason that TPR3 is an ideal tool for the task above described, since it has been specifically designed to endure the critical conditions it undergoes during the casing perforation using the tubing conveyed perforation system and high penetration casing perforation. It has been tested under several working conditions, having obtained excellent results in all cases. Said results show that even when the TPR3 has been developed to be used in casing perforation using the tubing conveyed perforation system and casing perforation with high penetration loads, its features make it suitable to be used without any drawback in other casing perforation methods or to block fluids in certain portions of the casing.

2. Description of the Prior Art

In the art some devices are presently used as a plug tool in wells where conventional casing perforation, high penetration casing perforation and casing perforation using the tubing conveyed perforation system are employed. Said devices are known in art as recoverable plugs. And their main drawbacks are shifting from the original position in the casing after the casing perforation and/or premature ruptures of its members due to the kind of works performed.

In the first place, there is a recoverable plug comprising gripping means with a double set of clamps working over two cones, blocking means with a double set of segments and a pressure equalizer valve with automatic drilling jar and no safety latch.

Secondly, there is a recoverable plug comprising gripping means with a single set of clamps actuated by means of a cone, blocking means with a double set of segments, hydraulic counterbalancing plunger to compensate the shift of the clamps in the casing and pressure equalizing valve with automatic drilling jar and safety latch.

Another variant in the art is a recoverable plug provided with gripping means, one set of double clamps actuating on two opposite cones, blocking means with double set of segments and rotation equalizing valve.

In the fourth place there is another embodiment comprising gripping means having opposite, double set of compression-actuated clamps and an integrated valve inside a mandrel working with "J" shaped latches.

Finally, there is an embodiment of the prior art wherein the plug is provided with a gripping means having a set of double clamps working over two cones, blocking means with a double set of segments and a valve with automatic drilling jar and safety latch.

The TPR3 shows several outstanding features over the prior art which allow to satisfy the needs and overcome any drawback of the existing plugs. The TPR3 includes gripping means provided by a double set of single, opposite clamps having a wall that work over two independent cones, latches with a double set of segments having a reinforced thread and equalizing valve with automatic drilling jar and safety latch. One of the main features of the TPR3 is its shock absorbing capacity, probably due to a shock absorbing device made of highly resistant rubber pieces which are strategically arranged. Said device allows to endure high pressure shots produced by high penetration casing perforation, casing perforation using the tubing conveyed perforation system and conventional casing perforation, avoiding shifting after such operations are made and also early ruptures of its members as a consequence of casing perforation.

Advantages of TPR3 over the five existing recoverable plugs are as follows:

As regards the first embodiment mentioned, the lockout valve of the invention provides the necessary safety so as to no to cause an unwanted release of the plug. The shock absorbing device allows endurance of shots produced by differential pressures caused by high penetration casing perforation, conventional casing perforation and casing perforation using the tubing conveyed perforation system, thus preventing shifting of the plug within the casing after said operations are made. The other plugs, even if they can endure the shots of the casing perforation using the tubing conveyed perforation system without having inner members damaged, they fall through the casing up to 15 meters when the explosive discharge takes place, and such shifting greatly reduces the efficiency of the process due to the expansion of the chamber where the discharge is produced. If there is a water production region below the area where the casing perforation is performed, the plug shifting may lead water flow to be mixed with the fluid obtained in the drilled area.

In some cases, the members of the standard plugs may early break as a consequence of the casing perforation. The lower mandrel and the blocking segments having reinforced thread features a tooling in the parts that are used in the deepest areas in the thread allowing to bear higher pressure and shots without causing early ruptures and providing a higher life to these parts.

As regards the second plug, the safety in latching is mechanically obtained and it is not dependant, as in the case of the hydraulic piston. Besides, it has the advantages provided by said shock absorbing device.

As regards the third embodiment already known, the addition of an automatic equalizing valve with safety latch prevents compulsory shifting to equalize pressures, but there is no assurance as regards the simultaneous release of the clamps. As in the previous comparisons, the addition of the shock absorbing device prevents shifting, as well as the addition of the automatic equalizing valve having a latch.

Reference is made now to the fourth embodiment. This invention ensures that no accidental block is created due to dirtiness in the "J" shaped internal valve, and such dirtiness may be washed with a dredger.

Regarding the fifth embodiment, this invention ensures that the plug shall not shift in the casing as said shock absorbing device is included. Also, because it does not have opposite, single clamps, but clamps which are supported in a completely independent way and a mandrel having a reinforced thread, the fixing to the casing is even more efficient.

In other aspects, it is a tool having three or four packing elements, depending on the configuration, that provide for the highest safety during insulation and that —notwithstanding how deep it is used and the inner diameters of the casing—have interchangeable diameters, compound quality and hardness.

The stroke of the packing allows that, even when two out of its three or three out of its four elements may be lost, the tool retains its insulating capacity.

The grips—comprising two sets of opposite, single clamps having a wall that allows an homogenous rest, with a large contact surface between the clamps and the pipe, thus avoiding that the shots may cause premature ruptures and two sets of independently-moving cones—allow for tightening of the tool to the casing when its own interlocking is required under the need of upwards and downwards motions.

Such set of opposite, single clamps with a wall is present in an attack option based on cement teeth or tungsten inserts which results in the benefit of a positive grip, even when the casing may be extremely hard (case number N-80, P-110, etc., according to part lists issued by the American Petroleum Institute). Thanks to the design of the clamps it may rest in full, including its back part on the casing, thus avoiding early ruptures since it is not designed with parts subject to neither lever motions nor pulling, but they are actuated by homogeneous compression.

Compression continuity in the packings, as well as the attachment of the clamps to the casing over its respective cones, is achieved through mechanical means having a reinforced thread and so, they are independent from the efforts generated by the differential pressures when the tool has been placed in the position of fixing.

The equalization of the by-pass pressure is ensured by an equalizing valve having an automatic sliding jar that shall be undoubtedly open when the plug is dredged, even when fixed and packed, while it will turn to automatically close when the detachment of the dredger takes place, which means that the tool has already been placed in its position.

The same equalizing valve having an automatic sliding jar, should upstream or downstream differential pressures exist, allows that such pressures be equalized before releasing the tool and provides a good degree of safety as regards the work and normalization time of the packing elements which results in a longer live.

The dredging system is an automatic "J" shaped grip and thus, suitable to match the pins of a conventional female dredger that, when entering into the plug while being lowered, opens its sliding valve proving at the surface level that the coupling has been made correctly. Besides, when the dredger is raised, some friction fingers are used to consolidate gripping during the lowering or pulling operations, thus avoiding the accidental loss of the tool and also, keeping the valve open to circulation.

Finally, its shock absorbing device—comprising rubber rings that associate the lower cone of the clamps with the joining sleeve and locking segments—prevents that shots, produced by conventional casing perforation, high penetration casing perforation and casing perforation using the tubing conveyed perforation system, be directly transmitted thorough the tool into the locking segments, damaging the reinforced thread of the lower mandrel which prevents shifting during such operations, and that these impacts be transferred to the casing as well as the early rupture of its pieces as a consequence of casing perforation.

SUMMARY OF THE INVENTION

It is therefore an object of the present invention to provide a recoverable, reinforced and vibration-damping plug for cased wells, said wells being for oil, water, gas or any other similar fluid. Said plug may be used for conventional casing perforation, high penetration casing perforation and casing perforation using the tubing conveyed perforation system, having the capacity of remaining in the same position as placed before the casing perforation without neither losing pressure nor shifting since it is furnished with an automatic pressure equalizing valve having a safety latch by means of a friction ring indicating the detachment of the dredger, packing elements, with gripping means attaching to the casing, including a double set of opposite, single clamps independently operating over the respective lower and upper cones, and position locking members comprising a double set of locking segments with reinforced thread; the plug is not only recoverable but it also prevents that its parts be damaged, basically due to the absorption of the energy produced by the explosives by means of a shock absorbing device made of rigid rubber members strategically arranged.

BRIEF DESCRIPTION OF THE DRAWINGS

To better understand the scope of this invention, it has been illustrated in a figure, wherein the preferred embodiment is represented, only for exemplary purposes, where.

DETAILED DESCRIPTION OF THE INVENTION

Figure 1:
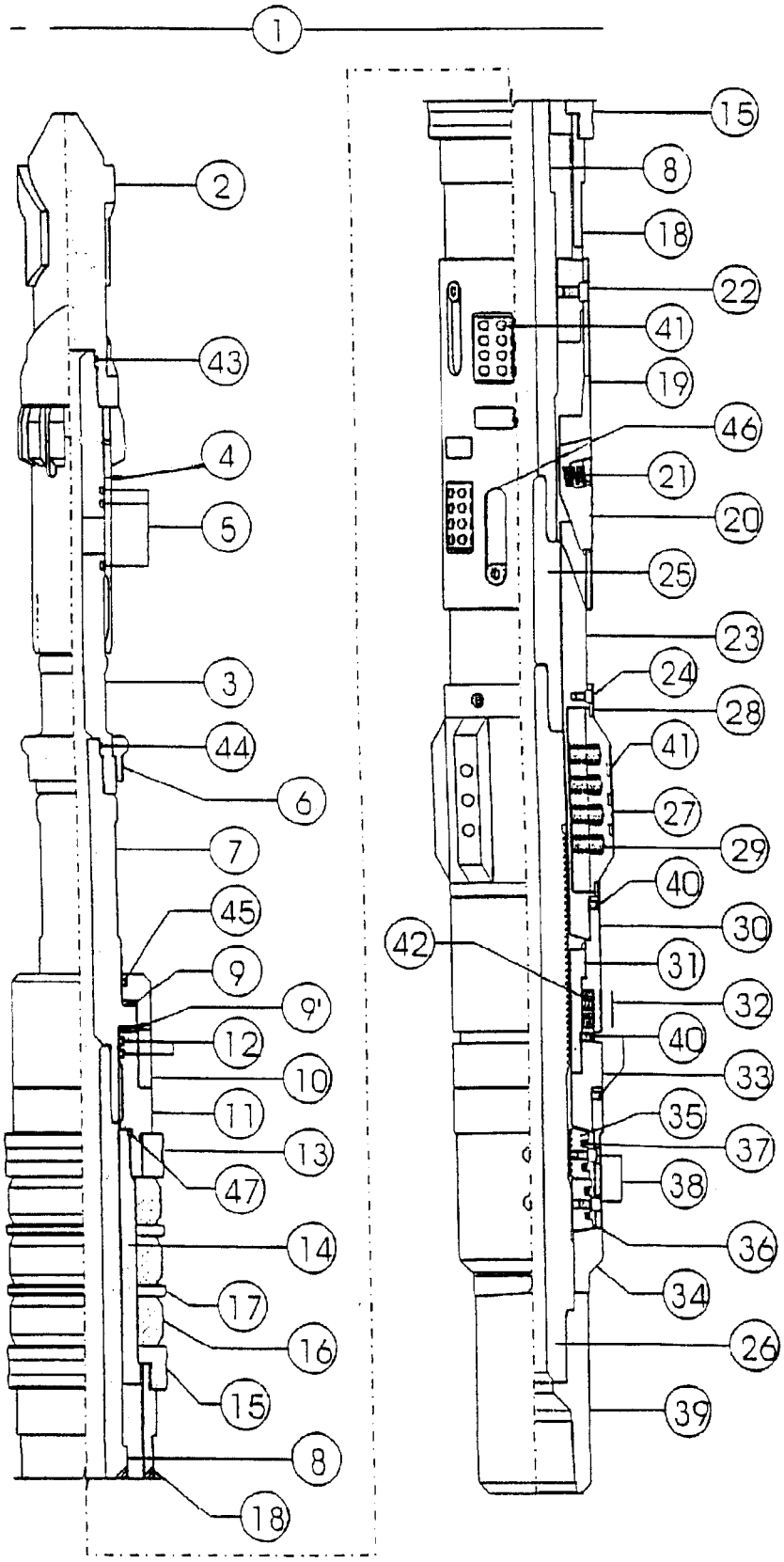
FIG. 1 shows a side view in vertical half section of the exemplary device of the present invention which is divided in two sections, obviously due to lack of space.

There follows the description of an example of a device of this invention, as can be seen in FIG. 1, wherein the recoverable, reinforced and vibration-damping plug, also called TPR3, intended for cased wells, is shown with general reference number 1. It comprises the dredging end 2 ("J" shaped), which is connected through a threaded coupling and sealed with a sealing ring 43 to the mandrel of valve 3, holder of the valve sleeve 4. Said valve 4 sleeve is mounted over valve 3 mandrel, bearing in mind the addition of sealing rings 5 and friction nut 6, which is an indicator of the dredger detachment (the part that denotes the detachment is included in the standard dredger, which is of the conventional type and is not illustrated herein), and comprises the friction fingers that press when going through the ring 6, and is screwed to the lower end portion of the valve 3 mandrel.

Said valve 3 mandrel is coupled by means of a thread to the mandrel adaptor 7 and is sealed with a sealing ring 44. In this case the valve mandrel 3 has a female thread, while the mandrel adaptor 7 has a male thread. On its turn, said mandrel adaptor is associated, also by means of a thread, with an upper end of the upper mandrel 8, and the upper stop 10 is mounted over the mandrel adaptor 7, with the upper 9 and lower 9' friction rings interleaved. Said upper stop 10 is screwed to the connecting sleeve 11 including a sealing ring, which seals above the mandrel adaptor 7. This also screws to the rubber-holder sleeve 14 and is supported by the mandrel adaptor 7 by means of two brass rings (upper friction ring 9 and lower friction ring 9'), which act as bearings. Said coupling also includes sealing rings 12.

The outer part of the lower end of the connecting sleeve 11 is screwed to the upper calibration ring 13, while the inner part of said end is screwed and sealed with a sealing ring 47 to the rubber-holder sleeve 14 that, between said upper calibration ring 13 and its matching lower member 15, is provided with multiple rubber packings 16 mounted thereon with interleaving separating rings 17.

Underlying the lower calibration ring 15, and in screwed association to said ring, there is an upper cone 18, which also gets into the clamp-holder sleeve 19, having simple, opposite clamps 20 with a wall and having tungsten carbide inserts 41 arranged over the clamp surface, contacting with the casing and with retractable springs 21. So as to limit the stroke of said clamps there are stop screws 22 which project through the corresponding grooves 46 longitudinally made in the body of the clamp-holder sleeve 19.

In the internal lower portion (female thread) of the upper mandrel 8 the upper projection of mandrel 25 is threaded (male thread), while in the lower inner portion (female thread) of mandrel 25 the upper portion (male thread) of internal mandrel 26 is threaded.

Below clamp 20 there is a floating lower cone 23. There are pulling blocks 27 mounted over the floating lower cone 23 being mounted by means of a stop ring of blocks 28 attached by means of screws 24. Said pulling blocks 27 are perimeter furnished with friction inserts 41, which are pushed by compression to a farther position with regard to the longitudinal axis of device 1 by the springs of the pulling block 29.

Following with the structural description of recoverable plug TPR3, it is possible to point that the guide sleeve 30 (female thread) is associated to cone 23 (male thread) by means of a left thread and remains fixed (with an "Allen" type screw 40). The vibration-damping device-bearer sleeve 31 is placed in its upper portion below the guide sleeve 30. The coupling between said sleeves allows for the vertical displacement since the vibration-damping device-holder sleeve 31 includes four male grooves in a longitudinally vertical position which are angularly symmetrical (not shown), and the guide sleeve 30 includes four respective female grooves in its inner forming, which are arranged similarly to the grooves of the vibration-damping-holder sleeve 31.

The vibration-damping device, characterized as general reference number 32 is composed by rigid rubber compressible rings and is housed between the vibration-damping device-holder sleeve 31, the guide sleeve 30 and it rests over the joining sleeve 33. The vibration-damping device-holder sleeve 31 (male thread) is threaded and fixed (by means of "Allen" screws 40) to the joining sleeve 33 (female thread) by means of a left thread. Also, a segment-holder sleeve 34 (female thread) is associated by means of a left thread to the joining sleeve 33 (male thread) and fixed (by means of "Allen" screws 40). Said segment-holder sleeve 34 comprises a set of four left locking segments 35 and a set of four right locking segments 36 furnished with their respective springs 37 and respective stop screws 38. Finally, the lower end of the lower mandrel 26 (male thread) is coupled to the upper portion of the lower adaptor 39 (female thread) by means of a thread.

Even when the vibration-damping device 32 is one of straightforward features, for the rubber rings 42 define a vibration-damping annular portion, the TPR3 presents real advantages compared to the previous art. This is due to the fact the rubber rings 42 slightly separate two large blocks of metal parts, which would otherwise leave the metal members in contact with other metal. Thus, in face of the impact caused by the explosive discharge, particularly due to the reaction generated by such energy based on the action-reaction principle, the energy applied to the relative motion that would displace the segments 35 over the threaded portion of the lower mandrel 26 is reduced since part of it is absorbed by the rubber rings 42. This prevents threads from breaking, both in segment 35 and in lower mandrel 26. The absorbed energy is enough to reduce the strength of the shot in such a rate that the members many endure the impact. Logically, when receiving the shots from casing perforation, almost all of the members of the plug are subjected to extreme stress, but thanks to the forming of the plug, the rubber rings 42 are strategically arranged, such as shown in FIG. 1.

As it may be understood, the vibration-damping criterion between parts may be applied not only on the plug of this invention, but also on other plugs already being used, as well as on existing packers and devices used for similar purposes in the application area that may be subjected to shots. In fact, the number of rubber rings used as vibration-damping device may be changed, the shape of said rings may be also altered, also properly sized springs may be used, as well as blowers, rubber cylinders and the like; also several rubber rings may be separated by metal rings so as to reduce deformation when receiving the shot and even the vibration-damping device having these features may be arranged in more than one portion of the plug. Nevertheless, the concept used in this invention remains unchanged.

Functionally, the recoverable plug made as already mentioned, should be provided with a conventional dredger (not shown) which is threaded to a string (not shown), attached by its dredging end 2. Once these three elements are mounted, it is possible to lower the TPR3 through the casing.

The dredger (not shown) has two main parts, i.e. the friction sleeve and the gripping fingers. In order to couple said dredger with the recoverable plug 1, the dredger is slipped through the upper part of the plug 1, so the friction sleeve of the dredger slips the valve 4 sleeve. When the valve 4 sleeve reaches the lower stop (jump of valve 3 mandrel), the friction sleeve of the dredger continues its lowering stroke over the valve 4 sleeve passing the friction ring 6. In this stroke, the "fingers" of the dredger cut through the "J" shaped portion of the dredging end 2 downwards, thus describing the stroke given by the geometry having the shape of a lowering helix of the "J". Further on, the dredger rotates rightwise by 45° due to the stroke of the fingers based on the geometry of the "J". Then, the dredger is pulled upwards and the friction sleeve passes again through the friction ring 6 upwards and the fingers of the dredger slips upwardly in a vertical way with no rotation (0°), so they remain trapped in the upper portion of the "J" shape of the dredging end. In this way, the friction sleeve remains between the friction ring 6 and the sleeve of valve 4 which is open. In this situation, plug 1 is in condition of being lowered to the well attached by the dredger, while said dredger is coupled to the string.

During the stroke of the TPR3 1 towards the bottom of the well to reach the required depth, the pulling blocks 27 are shifted inwardly the TPR3 1, thus compressing the springs against the body of the lower cone 23. In fact, this a desired effect over the pulling blocks 27, since the assembly of the lower cone 23, the expanded springs 29 and the pulling blocks 27 should have a larger diameter than the casing. This is a desired effect because there must be some part of the plug 1 that should remain integral to the "casing" and allows the motion relative to plug 1 so it can be fixed.

When the assembly (plug 1 and dredger) reaches the required depth, the string attached to the assembly is weighted (this is called "neutral point of the string), and the string is rotated leftwise about 6 turns, simultaneously to the rotation motion the lowering motion continues. At this point, lower segment 36 (having a right thread) screwed (it will work as a nut) to the segment-holder sleeve 34, which is integral (because it is threaded to the joining sleeve 33 and to the vibration-damping device-holder sleeve 31 and to the guide sleeve 30) to the body of the lower cone 23, is unscrewed from the lower mandrel 26 (which includes two threads: a left, reinforced upper thread which is longer and a right, lower and small thread which allows about 6 turns). This motion is possible thanks to the relative motion created by the assembly comprising a block-holder and a mandrel forming a rigid assembly with a dredging end 2, being moved by the dredger fingers. Once the inner thread in mandrel 26 is released from the lower segment 36 (and also from the whole assembly), the assembly remaining at all times integral to the casing, the mandrel can continue moving downwards. So, the upper cone 18 (which is associated to the whole upper assembly: rubber-holder sleeve, etc., to the dredging end) and the lower cone 23, start to come closer. As cones 18 and 23 come closer, clamps 20 start shifting to the outer of the periphery of the TPR3 1 body; so they are progressively projected towards the inner surface of the casing, thus the TPR3 1 is coupled to the casing in two perimeter radius, one upper and one lower, which are defined by upper and lower clamps.

While this motion takes place, the package of segments (upper 35 and lower 36), start to run the upper left thread of lower mandrel 26, this motion is made without rotation (since in this step, the string is not being rotated, but it is only being shifted downwards). The left, upper thread of the lower mandrel 26 has a tooth geometry arranged so as to allow that two segments be slipped there through upwardly, but not downwardly. Continuing with the downward motion of the string, once plug 1 is anchored to the casing by means of clamps 20, the rubber packings 16 are compressed: when clamps 20 reach the anchorage of the casing, the upper cone 18 does not continue descending since it is jammed by the upper clamp package, so the rubber-holder sleeve 14 continues moving downwardly and gets into the upper cone 18, so it holds the compression of the rubber packages inwardly, thus directing the expansion of the rubbers towards the casing so that plug 1 may be tightly sealed.

Rubber packings 16 are compressed between the rings 13 (integral to the upper portion of plug 1) and 15 (integral to the upper cone 18). In this operation, plug 1 is provided with the weight necessary for the operation to be performed and, thus, the upper segment 35 slipping through the thread downwardly shall be locked at any point of the thread stroke when a slight downward motion takes place, so once the lower mandrel 26 stops moving, segment 35 shall not shift downwards. Therefore, when the downward motion stops, upper segment 35 shall remain at any point of the upper thread of lower mandrel 26 and shall hold expansion effort of the rubber packings 16. Under these circumstances, the mechanism intends to return to its original position due to the energy stored in the rubber packings 16 and since the upper segment 35 does not slip downwards, it rests over the coupling sleeve 33, which compresses the vibration-damping rubbers 32 included and supported between the vibration-damping-device holder sleeve 31 and the guide sleeve 30. In this way, the lower cone 23 also remains jammed to lower clamps and the lower clamps remain jammed to the casing.

Continuing with the operation, the string is raised again, i.e. the dredger is pulled upwards so as to verify whether plug 1 is correctly fixed and after the neutral point thereof the stress will raise, meaning that the plug is correctly fixed.

Then, the string is lowered once again, resting on plug 1 through the dredger. When the dredger is slipped downwards, friction sleeve passes by friction nut 6. It is pressed downwards simultaneously to the leftwise turn of the string, so when it is raised the fingers of the dredger run the stroke inverse to the stroke run when entering into the "J" shape of the dredging end and thus, it may be detached from the dredger of the TRP3 1.

When the dredger is slipped upwards, the friction sleeve shall pass first through the friction ring 6 of the TPR3 1. Then, it closes the sleeve of valve 4, thus producing a completely vacuum seal between the upper and lower portions of the casing separated by plug 1. Once the valve 4 sleeve gets in contact with the lower part of the dredging end 2, the friction sleeve of the dredger goes through such valve 4 sleeve. While this motion takes place, the "fingers" of the dredger run the geometry of the "J" shaped end of the dredging end 2, defining an upward stroke and a turn of 45° leftwise. So, it is completely detached from dredger of TPR3 1.

Once plug 1 is fixed, casing perforation or any other operation as required is done. Then, plug 1 should be released from the coupling position in the casing. For that purpose the string is lowered to a depth close to the location where plug 1 is placed. Once the string reaches the correct depth, said string is slowly lowered, so the dredger couples over the dredging end 2. Then, when the string is raised, the weight of the string notoriously increases due to the TPR3 anchorage to casing. The coupling of the dredger to plug 1 is done similarly to the procedure described here above.

When the valve 4 sleeve is open, there is a communication between the upper and lower portions of the plug, so before starting the releasing, both upper and lower pressures of the casing portions separated by plug 1 are equaled. Then the string is shifted rightwise with a slight stress until it is noticed that the vertical strength (weight) exerted over said string is reduced. Then the string continues to be shifted rightwise with stress until it is noticed that TPR3 1 detaches from the casing.

Generally, it is verified that plug 1 is completely released, thus verifying it is possible to easily move the string downwards and upwards.

Having described the nature and scope of this invention, it is claimed:

1. A recoverable, reinforced and vibration-damping plug for cased wells, said wells being for oil, water, gas or any other similar fluid, wherein the plug may be connected to a conventional tool for installation into, and removal from, conventional casing perforation, high penetration casing perforation and casing perforation using the tubing conveyed perforation system, the plug comprising:

a dredging end for connecting to the conventional tool;

a pressure equalizing valve mounted in a holding body;

a friction ring in the holding body defining a means to show any detachment of the plug from the conventional tool;

packing and clamp means to attach to the casing, with the clamp means having friction inserts;

position locking means comprising an upper, leftward locking segment and a second lower, rightward segment, which are respectively furnished with springs and stop screws, and a shock absorbing device comprising vibration-damping means arranged in a section of the plug and defining an elastic impact means upon receipt of action-reaction effects from any shot received by the plug due to any discharge produced by a casing perforation method that creates sudden pressure differences in portions of the casing defined above and below the plug.

2. The recoverable plug of claim 1, wherein the vibration-damping means define a vibration-damping means at a lower section of the plug to protect any component of the plug from rupture or crack.

3. The recoverable plug of claim 1, wherein the vibration-damping means are laterally contained in at least one inner tubular member and at least one outer tubular member defining confinement means to prevent side deformation of the vibration-damping means.

4. The recoverable plug of claim 2, wherein the vibration-damping means are longitudinally contained in at least one tubular supporting member and at least one stop tubular member, defining confinement means to prevent longitudinal deformation of the vibration-damping means.

5. The recoverable plug of claim 3, wherein the vibration-damping means are longitudinally contained in at least one tubular supporting member and at least one stop tubular member, defining confinement means to prevent longitudinal deformation of the vibration-damping means.

6. The recoverable plug of any of claims 1 to 5, further comprising an upper cone above the clamp means and a lower cone below the clamp means, wherein the clamp means comprise two sets of opposing single clamps independently operative over the respective upper and lower cones, the clamps together defining a double perimeter fixing means of the plug to the casing.

7. The recoverable plug of claim 6, further comprising at least one threaded mandrel to actuate the clamps and at least one metal member mounted over springs that screw over said mandrel which threads are deep tooth-shaped and wide, defining a resistance means which is effective to endure the stress which said threads undergo during the casing perforation.

8. The recoverable plug of claim 7, wherein the tooth shaped threads provide a longitudinal shifting, in a first direction, between said mandrel and said metal member mounted over springs, without relative turning between the mandrel and metal member.

9. The recoverable plug of claim 8, wherein the tooth shaped threads provides a longitudinal shifting, in a second direction, between said mandrel and said metal member mounted over springs, requiring at least the turn of at least one of the mandrel and the metal member.

10. The recoverable plug of any of claims 1 to 5, wherein the vibration-damping means are chosen between the group consisting of springs, rubber rings and rubber cylinders.

* * * * *